US006336793B1

(12) United States Patent
Litvin

(10) Patent No.: US 6,336,793 B1
(45) Date of Patent: Jan. 8, 2002

(54) COMBINATION FLOOR AND WALL MOUNT PIVOTING FAN

(75) Inventor: Charles Litvin, West Chester, PA (US)

(73) Assignee: Lasko Holdings, Inc., West Chester, PA (US)

( * ) Notice: Subject to any disclaimer, the term of this patent is extended or adjusted under 35 U.S.C. 154(b) by 0 days.

(21) Appl. No.: 09/594,413

(22) Filed: Jun. 16, 2000

(51) Int. Cl.[7] ..... F04B 17/00; B63H 1/28; B63H 1/00; A47G 29/00

(52) U.S. Cl. ..... 417/360; 416/246; 416/247 R; 248/126

(58) Field of Search ..... 417/360; 416/246, 416/247 R; 248/126; D23/370

(56) References Cited

U.S. PATENT DOCUMENTS

| | | | | | |
|---|---|---|---|---|---|
| 2,857,095 | A | * | 10/1958 | Grau | 416/246 |
| 4,222,318 | A | * | 9/1980 | Patton et al. | 248/126 |
| D426,296 | S | * | 6/2000 | Blateri | D23/382 |
| 6,183,203 | B1 | * | 2/2001 | Grintz | 416/246 |
| D444,552 | S | * | 7/2001 | Wang | D23/382 |

* cited by examiner

*Primary Examiner*—Charles G. Freay
*Assistant Examiner*—Michael K. Gray
(74) *Attorney, Agent, or Firm*—Zachary T. Wobensmith, III

(57) ABSTRACT

A combination floor and wall mount pivoting fan which can be placed on a floor or other supporting surface, and also hung from at least a bracket on a wall, with a base on the fan engaging hooks on the bracket which is attached to the wall.

6 Claims, 7 Drawing Sheets

COMBINATION FLOOR AND WALL MOUNT PIVOTING FAN

BACKGROUND OF THE INVENTION

1. Field of the Invention

This invention relates to a combination floor and wall mount pivoting fan, which is adjustable for air direction, with a base that can sit on a supporting surface, and can be mounted to a wall by a bracket or brackets which are permanently attached to the wall.

2. Description of the Prior Art

Combination fans that can be placed on a surface or mounted on a wall are desirable for many applications, and particularly where it is important to be able to change the direction of the air flow, such as in a commercial establishment.

While fans are often placed on the floor or on an elevated surface, it is useful to be able to quickly mount the fan on a wall in order to get the fan out of the way for storage, or to change the height and direction of the air flow, and to easily be able to return the fan to a horizontal surface for use thereon. It is also desirable to be able to pivot the fan in order to change the direction of the air flow. Wall mounted fans that are permanently attached to a wall and fans that sit on the floor or in a window are available, however no combination floor and wall mount pivoting fan is available.

The fan of the invention can sit on a horizontal surface, can be pivoted to change direction of the air flow, be easily mounted and demounted from a wall bracket, and pivoted to change the direction of the air flow.

SUMMARY OF THE INVENTION

It has now been found that a combination floor and wall mount pivoting fan is available, which is pivotable for air direction, which can rest on a supporting surface, and can be mounted to a wall by a bracket or brackets which are permanently attached to the wall.

The principal object of the invention is to provide a combination floor and wall mount pivoting fan.

A further object of the invention is to provide a fan of the character aforesaid wherein the fan can be mounted on a wall by a bracket or brackets, for use or storage.

A further object of the invention is to provide a fan of the character aforesaid which does not require the use of any tools to go from a floor mount to a wall mount and vice versa.

A further object of the invention is to provide a fan of the character aforesaid which is easy to use.

A further object of the invention is to provide a fan of the character aforesaid which can be pivoted to change air flow direction while on the floor, or on a wall.

A further object of the invention is to provide a fan that has vibration isolators thereon.

A further object of the invention is to provide a fan of the character aforesaid which provides a large number of air flow directions.

A further object of the invention is to provide a fan of the character aforesaid that is sturdy and reliable in operation, and is securely mounted.

A further object of the invention is to provide a fan of the character aforesaid that is simple and inexpensive to construct.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

It should, of course, be understood that the description and drawings herein are merely illustrative and that various modifications and changes can be made in the structures disclosed without departing from the spirit of the invention. Like numerals refer to like parts throughout the several views.

DESCRIPTION OF THE PREFERRED EMBODIMENT

Figure 1:
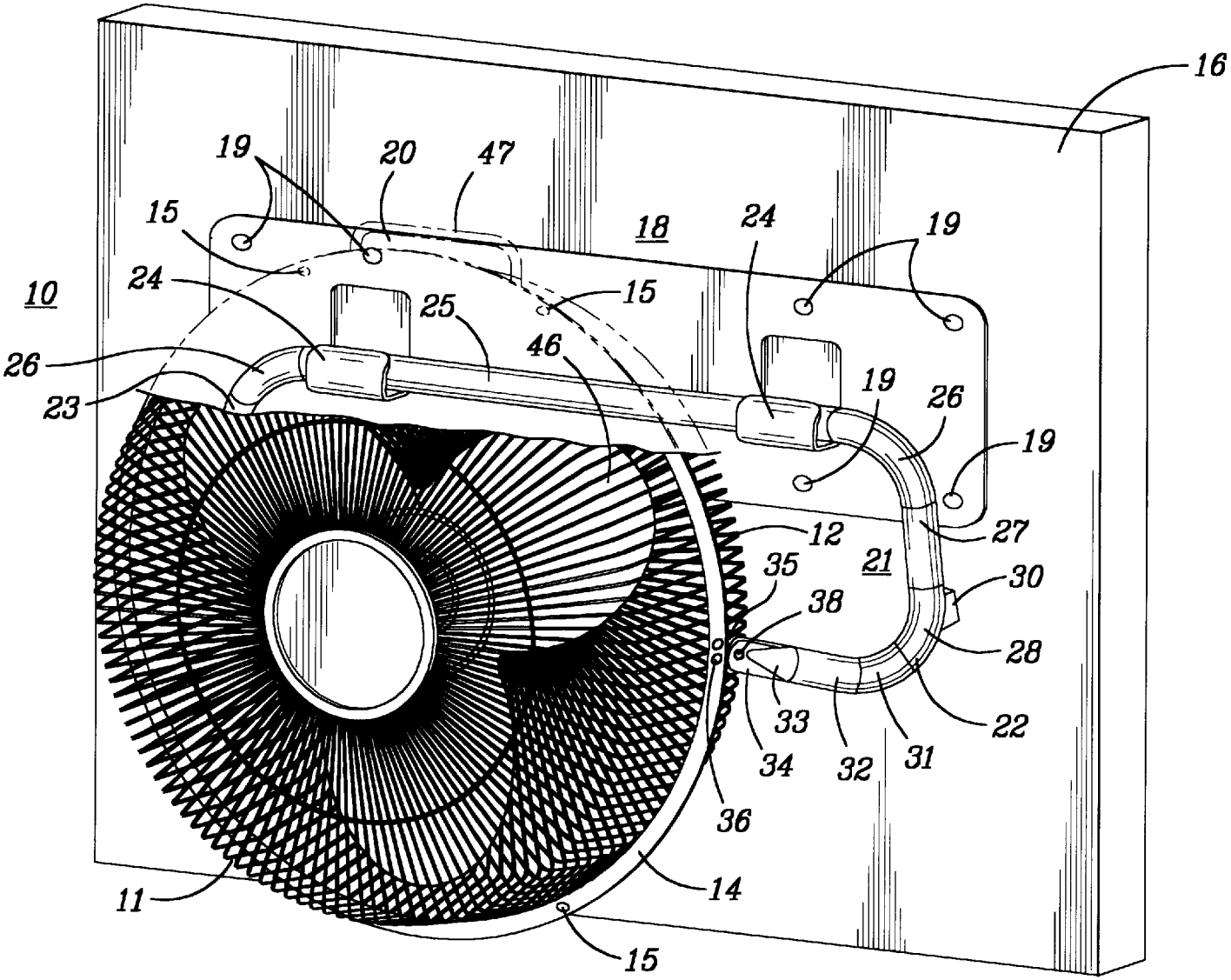
FIG. 1 is a perspective view of the combination floor and wall mount pivoting fan of the invention, showing the fan mounted to a wall.
Figure 2:
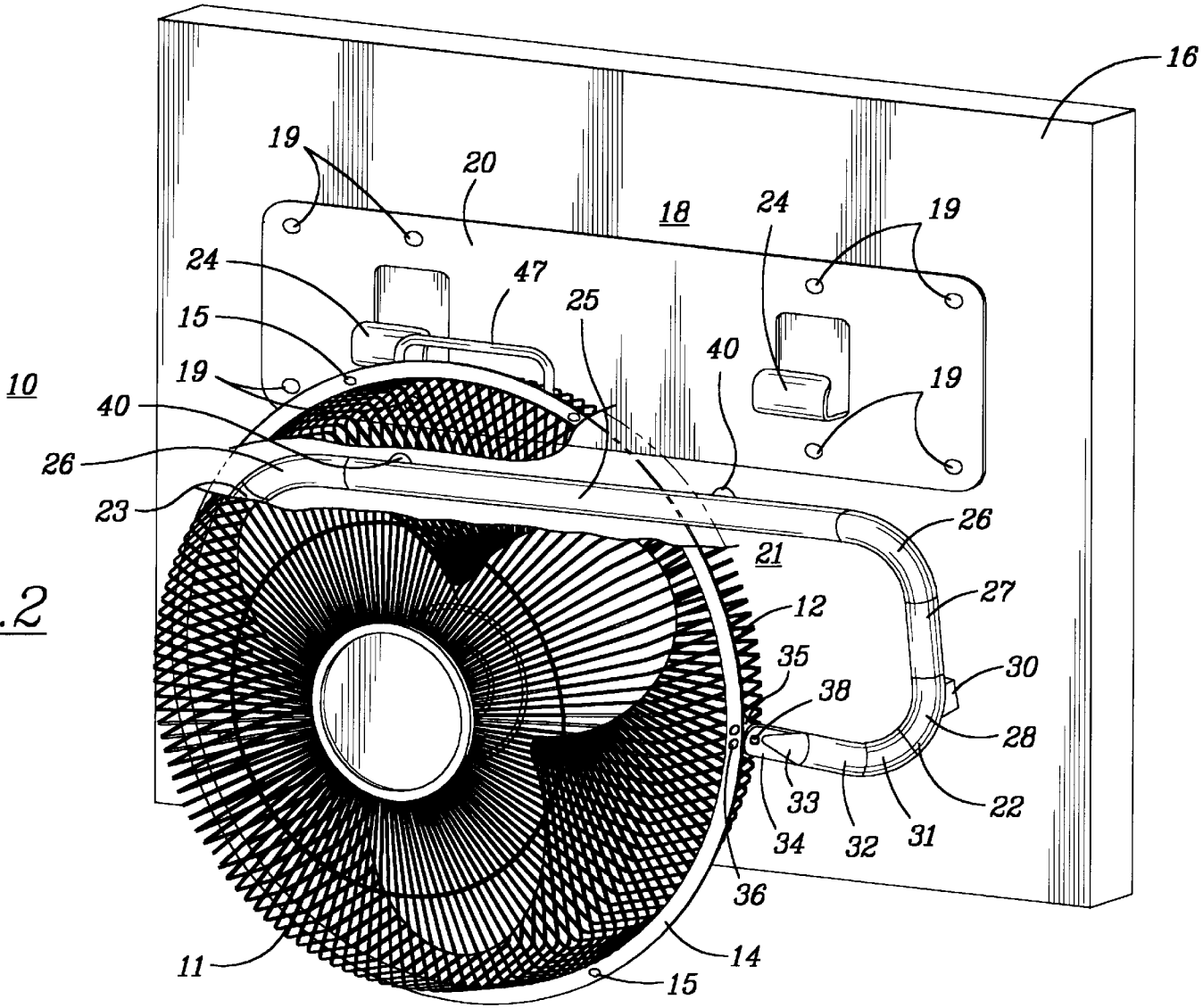
FIG. 2 is a view similar to FIG. 1, showing the fan detached from the wall mount bracket.

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1–6 of the drawings, the combination floor and wall mount pivoting fan 10 includes a circular front grill 11, and a rear grill 12, attached together around a rim 14, by screws 15 in well known manner.

The grills 11 and 12 can be formed of metal or plastic.

A portion of wallboard 16 is shown, which as shown has a single piece bracket 18 attached thereto by screws 19 of well known type. The bracket 18 can be of one or two pieces as desired. The bracket 18 is preferably formed of sheet metal by stamping, but could be molded or cast as required.

The screws 19 can be engaged in studs (not shown) behind wallboard 16, on sixteen or twenty four inch centers as required.

The bracket 18 includes a rectangular plate 20 with two semicircular upstanding hooks 24 extending therefrom.

Figure 3:
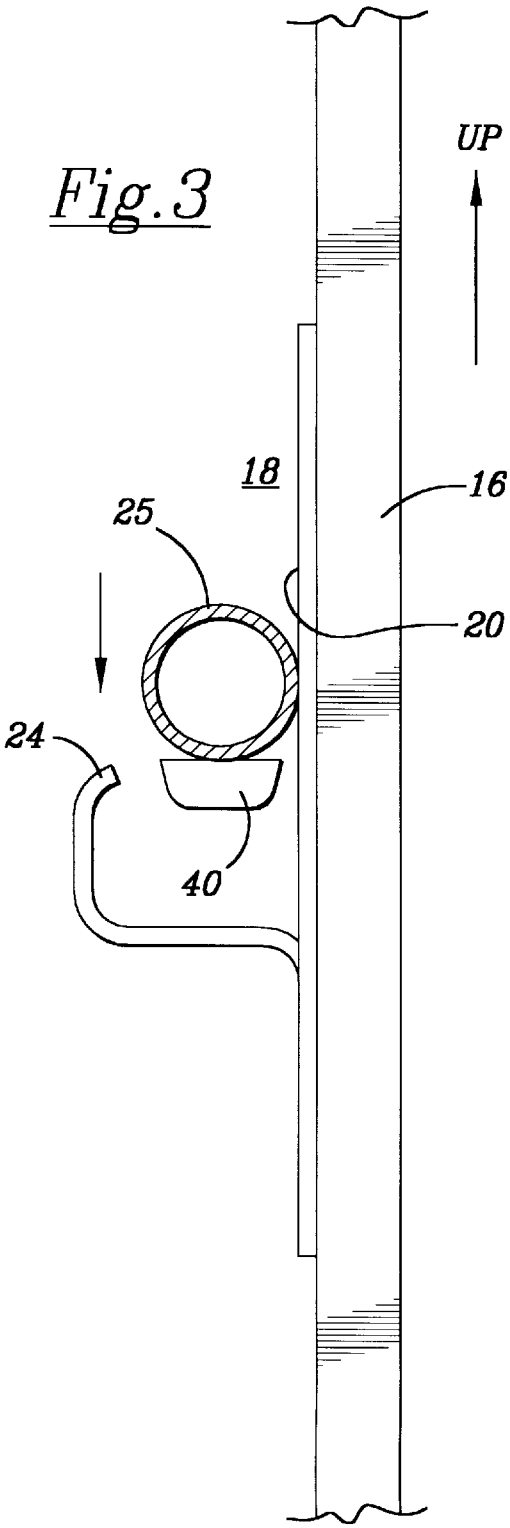
FIG. 3 is a fragmentary side elevational of the fan of FIG. 1 prior to mounting onto the wall bracket.
Figure 4:
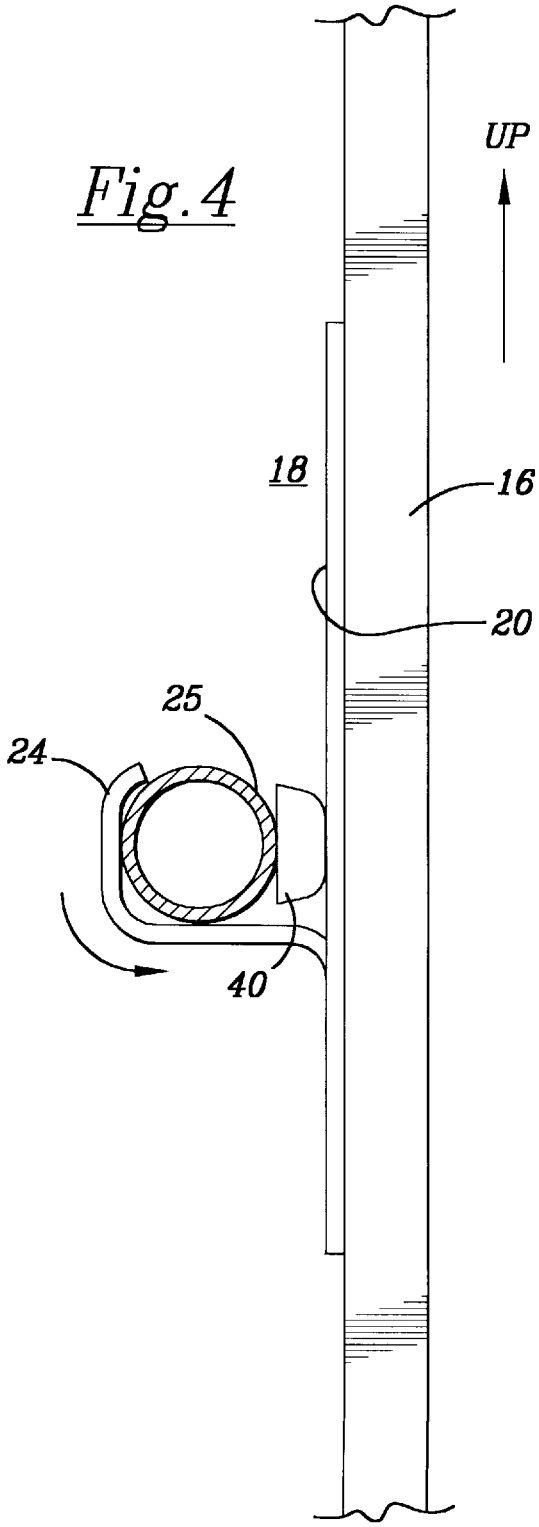
FIG. 4 is a view similar to FIG. 3 showing the fan base engaged with the wall bracket.

The fan 10 includes a tubular generally U shaped base 21 which has side portions 22 and 23 connected together by a straight portion 25, which in FIGS. 1, 3 and 4 is engaged with hooks 24 for mounting fan 10 to wallboard 16.

The base 21 side portions 22 and 23 are of multi-piece construction, with telescoping curved members 26 extending into the straight portion 25 with straight portions 27 connected thereto, which have curved portions 28 engaged therewith and have feet 30 thereon. The feet 30 contact wallboard 16 and isolate it from the fan vibrations when mounted to the bracket 18, as well as protecting the surface of the wallboard 16 from marring.

The curved portions 28 have curved portions 31 connected thereto, with straight portions 32 connected thereto, and to connectors 33, which have a flat portion 34, which has a rubber washer 35 adjacent thereto, and with rivets 38 therein snugly connecting it to a bracket 36, which is connected by rivets 37 to rim 14. The grills 11 and 12 fan can pivot about the rivets 38 to change the air flow direction and the compressed washers retain them in the selected positions. The straight portion 25 of base 21 has two additional feet 40 thereon, which engage the plate 20 of bracket 18 when fan 10 is mounted in bracket 18 and urge the straight portion 25 into contact with the hooks 24 for improved retention. The feet 30 and 40 are preferably formed of any suitable resilient rubber material.

A fan motor 45 of well known type is provided mounted to the rear grill 12 in conventional well known manner, and has a fan hub (not shown) with a plurality of blades 46 thereon.

The fan 10 has an on/off switch (not shown) which is connected to the fan motor 45 by wires (not shown) and a power cord (not shown) is also connected to fan motor 45 and to a source of electrical power (not shown), in well known manner.

The fan 10 is also provided with a carrying handle 47 which is connected to rear grill 12.

Figure 5:
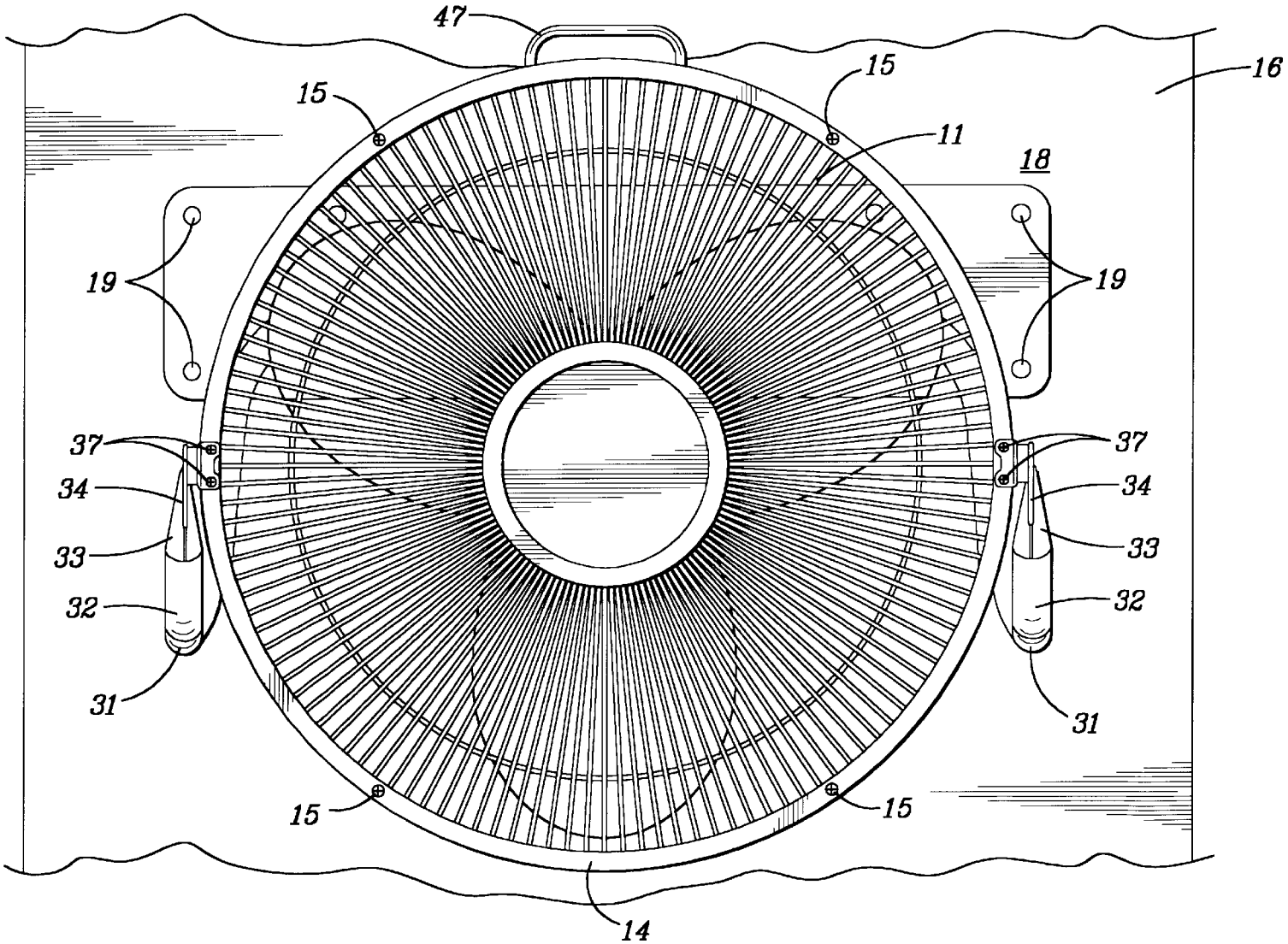
FIG. 5 is a front plan view of the fan of FIG. 1.
Figure 6:
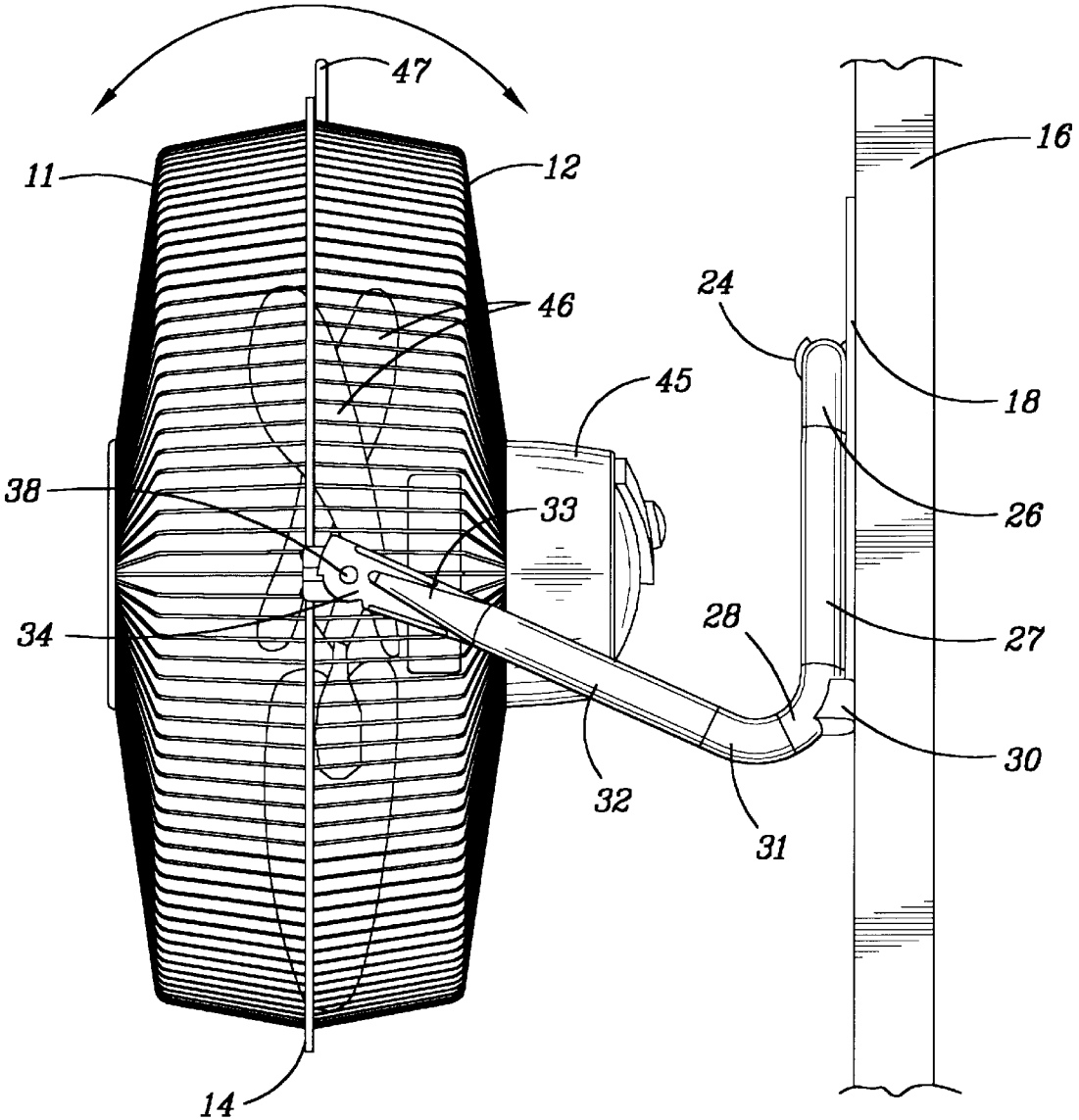
FIG. 6 is a right side elevational view of the fan of FIG. 1.
Figure 7:
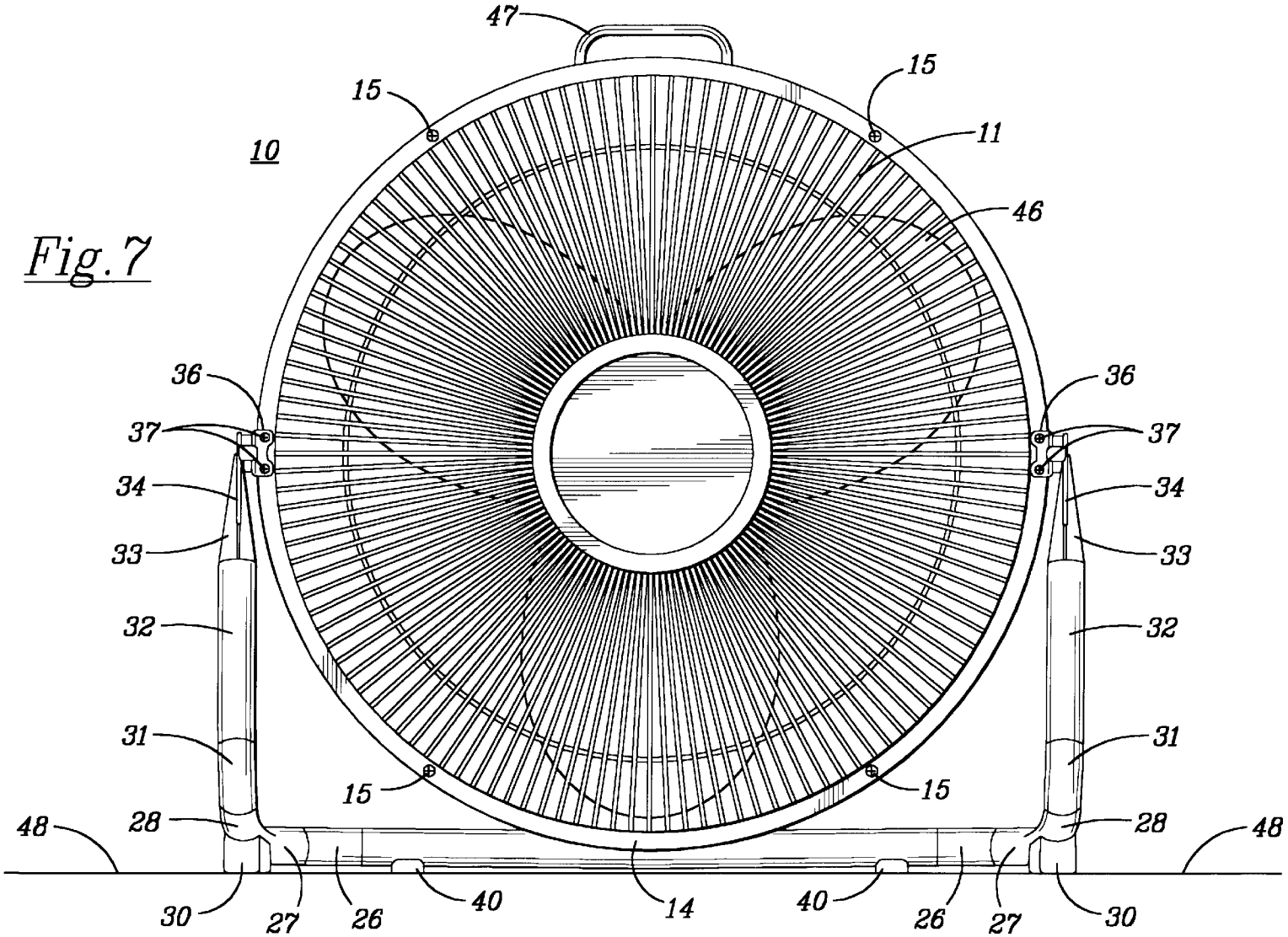
FIG. 7 is a front elevational view of the fan resting on a horizontal surface.
Figure 8:
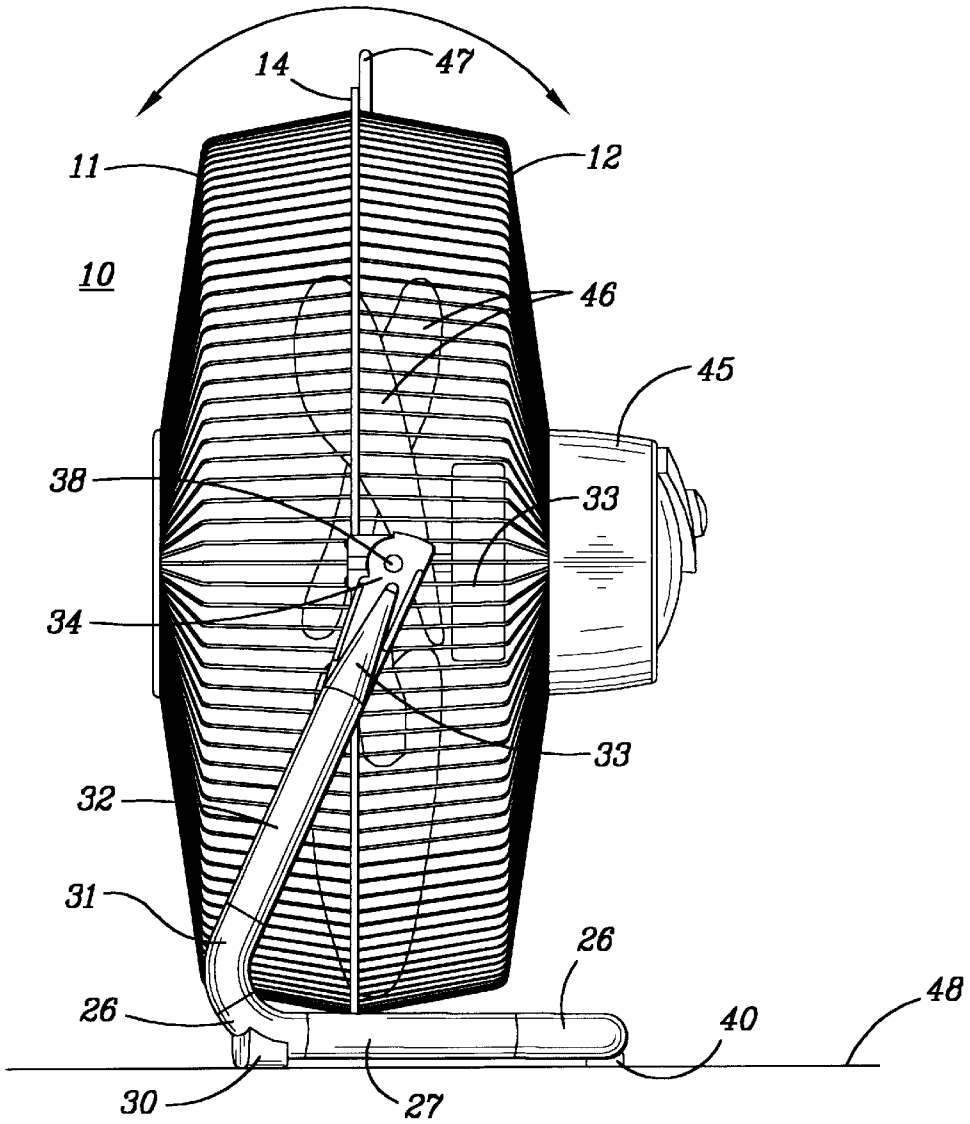
FIG. 8 is a right side elevational view of the fan of FIG. 7.

Referring additionally to FIGS. 5 and 6 the fan 10 shown therein is as described for FIGS. 1–4, with the fan 10 shown with its base 21 on a surface 48 which can be a floor.

When the fan 10 is to be mounted in bracket 18 the portion 25 is raised above hooks 24 with feet 40 in position as shown in FIG. 3, and portion 25 is inserted in hooks 24 and rotated as shown in FIG. 4. The feet 40 contact plate 20 and force portion 25 into contact with hooks 24 resisting dislodgement from hooks 24.

It will thus be seen that a combination floor and wall mount pivoting fan has been described with which the objects of the invention are achieved.

I claim:

1. A combination floor and wall mount pivoting fan, which may sit on a supporting surface, or be mounted to a wall by at least one bracket, the improvement which comprises;

a fan having a front grill and a rear grill;

a fan motor mounted to said rear grill;

a fan hub connected to said motor;

a plurality of fan blades connected to said hub;

a base pivotally connected to said grills;

at least one bracket mounted to said wall;

said bracket including a plate, and;

semicircular hook means extending from said plate for engagement with said base to selectively mount said fan on said wall.

2. A combination floor and wall mount pivoting fan as defined in claim 2 in which said base has at least two pairs of feet thereon for contact with said wall or said surface.

3. A combination floor and wall mount fan as defined in claim 2 in which:

at least one pair of said feet on said base are in contact with said plate when said fan is mounted on said wall to urge said base into contact with said hook means for retention.

4. A combination floor and wall mount pivoting fan as defined in claim 1 in which:

said at least one bracket is of stamped metal.

5. A combination floor and wall mount pivoting fan as defined in claim 1 in which:

said base is pivotedly connected to said fan grills by retaining means extending through plates on each side connected to brackets on said fan, and resilient washers are provided between said plates and said brackets, whereby the position of said fan grills and said base can be selected to change the air flow direction of said fan.

6. A combination floor and wall mount pivoting fan as defined in claim 1 in which said rear grill has a carrying handle thereon.

* * * * *

UNITED STATES PATENT AND TRADEMARK OFFICE

CERTIFICATE OF CORRECTION

PATENT NO. : 6,336,793 B1
DATED : January 8, 2002
INVENTOR(S) : Charles Litvin

It is certified that error appears in the above-identified patent and that said Letters Patent is hereby corrected as shown below:

Column 4,
Line 16, after "claim" delete "2" and insert -- 1 --.

Signed and Sealed this

Sixth Day of August, 2002

*Attest:*

*Attesting Officer*

JAMES E. ROGAN
*Director of the United States Patent and Trademark Office*